US006357908B1

(12) United States Patent
Hunziker

(10) Patent No.: US 6,357,908 B1
(45) Date of Patent: Mar. 19, 2002

(54) TIMEPIECE INCLUDING A MOVEMENT MOUNTED IN A CASING RING

(75) Inventor: Yannick Hunziker, Delémont (CH)

(73) Assignee: Eta SA Fabriques D' Ebauches, Grenchen (CH)

( * ) Notice: Subject to any disclaimer, the term of this patent is extended or adjusted under 35 U.S.C. 154(b) by 21 days.

(21) Appl. No.: 09/669,904

(22) Filed: Sep. 27, 2000

(30) Foreign Application Priority Data

Sep. 28, 1999 (CH) ..... 1769/99

(51) Int. Cl.[7] ..... G04B 37/00; G04B 39/00
(52) U.S. Cl. ..... 368/287; 368/294; 368/299
(58) Field of Search ..... 368/287, 294–300, 368/309

(56) References Cited

U.S. PATENT DOCUMENTS 3,733,807 A 5/1973 Nozawa
4,110,970 A * 9/1978 Funazawa et al.
4,626,108 A * 12/1986 Ganter ..... 368/291

FOREIGN PATENT DOCUMENTS

| | | |
|---|---|---|
| CH | 499 817 | 11/1970 |
| CH | 568 607 | 10/1975 |

* cited by examiner

*Primary Examiner*—Vit Miska
(74) *Attorney, Agent, or Firm*—Sughrue Mion, PLLC

(57) ABSTRACT

A timepiece including a case (24) provided with a back cover (28) and a middle part (26), a movement (30) mounted in the casing ring (32), a dial (34) mounted above the ring (32) and a crystal (36) mounted above the dial (34), said crystal (36) being provided with an annular collar (70) surrounding the flank (64) of the dial (34), characterised in that the casing ring (32) includes means (38) arranged to remove all the play inherent in the dimensional tolerances of the dial (34), the ring (32) and the back cover (28) of the case (24), these means (38) on which the collar (70) of the crystal (36) is supported being arranged at the upper end of the ring (32), along the outer circumference (86) thereof.

6 Claims, 8 Drawing Sheets

TIMEPIECE INCLUDING A MOVEMENT MOUNTED IN A CASING RING

The present invention concerns a timepiece including a case provided with a back cover and a middle part, as well as a casing ring arranged to contain a movement fitted with hands moving above a dial, the ring extending over substantially the entire height of the middle part into which it is fitted.

Assembling a watch usually includes the following steps in succession. First of all, the movement is introduced into the casing ring by orienting these two parts so that, if the parts are round, a raised portion of the casing ring penetrates a recess of the movement. Secondly, a dial is placed on the ring. When the dial is pressed against the ring, the latter is definitively secured for example by ultrasound welding. The hands of the movement are then set in place. The casing ring is then introduced via the top of the case and it is made to slide until it abuts against the back cover thereof. The movement also includes a time-setting stem onto which a crown is fitted. This time-setting stem assures the angular orientation of the ring with respect to the middle part when the watch is being assembled, in the event that the middle part and the ring have a round configuration. It will be understood that, in such case, the holes made respectively in the middle part and the casing ring have to be aligned to allow the time-setting stem to pass through. The watch also includes a crystal mounted above the dial and secured to the case by means of a bezel engaged in a notch provided in the upper periphery of the middle part.

The assembly method which has just been described has the drawback that it is difficult, because of plays inherent in the dimensional tolerances of the dial, the casing ring and the back cover of the case, to assure a determined and precise height position of the movement with respect to the case. In certain cases, the vertical play of the ring with respect to the case can be recovered due to the pressure exerted by the bezel under the effect of which the ring tends to become elastically deformed. However, this occurs at the cost of a constant reaction pressure of the ring against the crystal which is then liable to become damaged or to slip out of the middle part.

In order to overcome this drawback and to allow more precise height positioning of the casing ring with respect to the case, providing the circle with means able to deform plastically to remove all dimensional play has been proposed. An embodiment example of such a ring is shown in FIGS. 1 and 2 annexed to the present Patent Application.

With reference to FIG. 1, one sees a cross-section of a timepiece designated as a whole by the general numerical reference 1. This timepiece 1 includes a movement 2 mounted in a casing ring 4, a dial 6 mounted above a casing ring 4 and a crystal 8 mounted above dial 6. Casing ring is mounted in a case 10 including a middle part 12 and a back cover 14 made in one piece with middle part 12. Crystal 8 rests on the top of middle part 12 and is secured thereto by a bezel 16 held in a notch 18.

The means allowing circle 4 to be positioned in height with respect to case 10 consist in a plurality of points 20 only one of which is shown in FIG. 1. These points 20 in the shape of cones are arranged under casing ring 4. They are, for example, four in number, arranged at an equal distance from each other to assure casing ring 4 is well seated on back cover 14. After setting in place casing ring 4 in case 10, the latter is pushed. Under the effect of this pressure, points 20 are crushed and deform plastically against back cover 14 of case 10, until casing ring 4 occupies a determined height position with respect to case 10. At that moment, cones 20 end, no longer in points, but in bulges as can be seen in FIG. 1, and more precisely still in FIG. 2 which is a detailed view of FIG. 1.

As will have been understood from the foregoing, the positioning means described above undergo plastic deformation, this deformation resulting in crushing the material irreversibly. Thus, when the casing ring is in place, it does not undergo any vertical pressure as is the case when it undergoes plastic deformation.

When used, the solution which has just been described, although constituting substantial improvement with respect to the state of the art, has nonetheless revealed certain drawbacks. In particular, it has been realised that the positioning means do not always allow the height of the casing ring to be adjusted with respect to the middle part as precisely as was wished. It will be understood that it is difficult to control rigorously the crushing and deformation of the points via which the casing ring rests on the back cover of the case. It has thus been observed that, in certain cases, it was not possible to align the holes made in the middle part and the casing ring in a suitable way for the passage of the time-setting stem. The stem thus tended to become blocked by seizing, which made the handling thereof difficult, or impossible.

The object of the present invention is to overcome the aforementioned drawbacks of the prior art by providing a timepiece including a casing ring able to be positioned with precision in the case and not exerting pressure in a way likely to remove the crystal from its housing.

The present invention thus concerns a timepiece including a case provided with a back cover and a middle part, a movement mounted in the casing ring, a dial mounted above the ring and a crystal mounted above the ring, this crystal being provided with an annular collar surrounding the flank of the dial, characterised in that the casing ring includes means arranged to remove all the play inherent in the dimensional tolerances of the dial, the ring and the back cover, these means on which the collar of the crystal is supported being arranged at the upper end of the ring, along the outer circumference thereof.

According to another feature of the invention, the means for removing the play due to the different dimensional tolerances are flexible strips able to be elastically deformed.

As a result of these features, it is possible to assure precise positioning of the movement with respect to the case. It is no longer necessary for the casing ring to be made of a material subject to plastic deformation as was the case in the prior art. The ring and the back cover of the case can then be machined with a high level of precision, typically of the order of several hundredths of a millimetre, compatible with good alignment of the time-setting stem passage holes which are made in the middle part and the ring. At the same time, any play due to the dimensional tolerances of the different parts (ring, dial, case back cover) is eliminated by the elastic deformation of the flexible strips arranged at the top end of the casing ring on which the crystal collar is supported. The sum of the different tolerances is substantially less than the deformation amplitude of the flexible strips which is of the order of two to three tenths of a millimetre. Thus, when the crystal is arranged above the ring and it its secured thereto by means of the bezel driven into a notch of the middle part, it abuts the strips, which has the effect of pressing the ring against the back cover of the case. Consequently, whether the play is positive or negative, the ring and the crystal are always suitably held in the case of the timepiece.

Other features and advantages of the present invention will appear more clearly upon reading the following detailed description of an embodiment example of the timepiece according to the invention, this example being given purely by way of illustrative and non limiting example, in conjunction with the annexed drawings, in which:

FIG. 1, which has already been cited, is a cross-section of a timepiece assembled according to a method of the prior art;

FIG. 2, which has already been cited, is a larger scale view of the region surrounded by a dot and dash line in FIG. 1;

The present invention proceeds from the general inventive idea which consists in providing flexible strips in the upper peripheral portion of a casing ring to eliminate the play due to dimensional tolerances of the casing ring, the dial and the back cover of the case. The crystal, pressed against the ring by the bezel engaged in a notch of the middle part, abuts elastically, on these strips via an annular collar surrounding the flank of the dial, and in turn presses the ring against the back cover of the case. Consequently, it is no longer necessary for the ring to be provided, in its inner part, with means able to be deformed in an elastic or plastic manner to eliminate construction play as was the case in the prior art. The ring and the back cover of the case may, consequently, be machined with a high level of precision, so that the holes for the passage of the time-setting stem made in the middle part and the ring can be suitably aligned.

Figure 1:
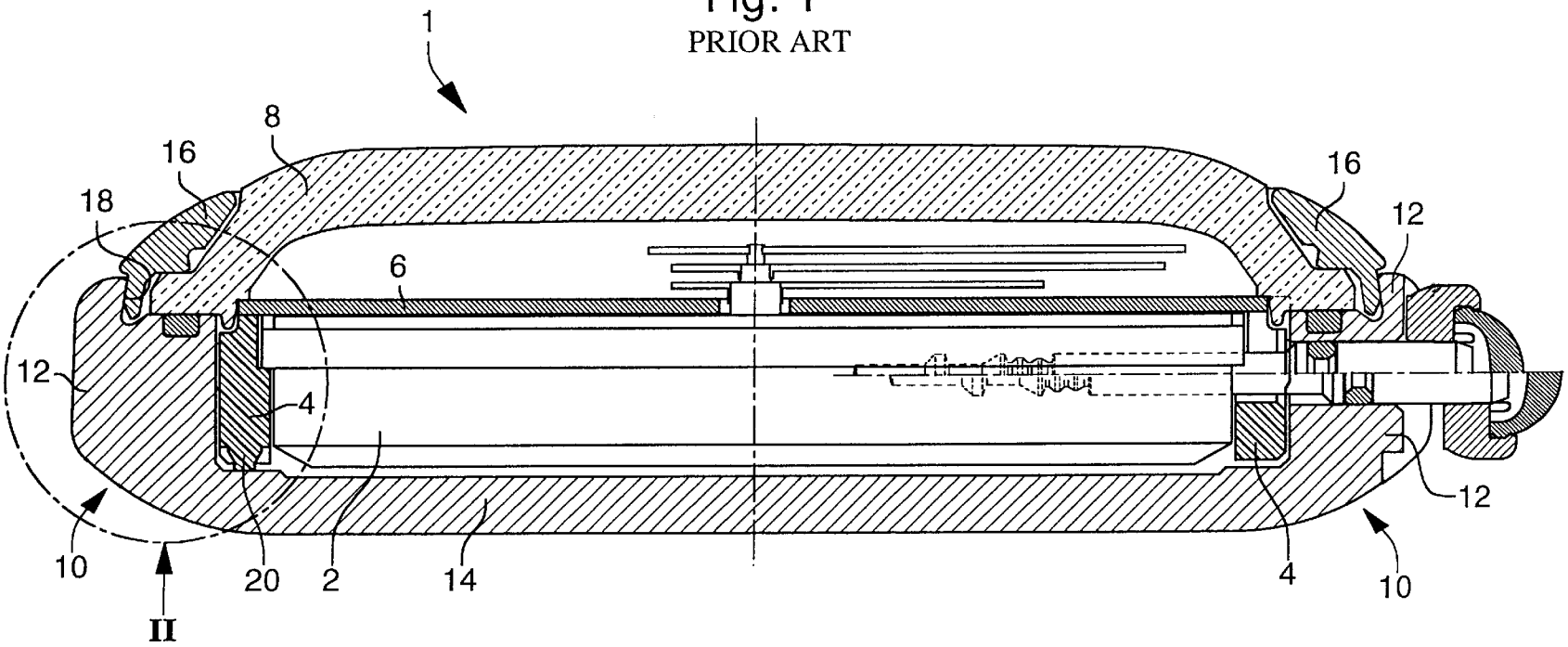
Fig. 1 PRIOR ART
Figure 2:
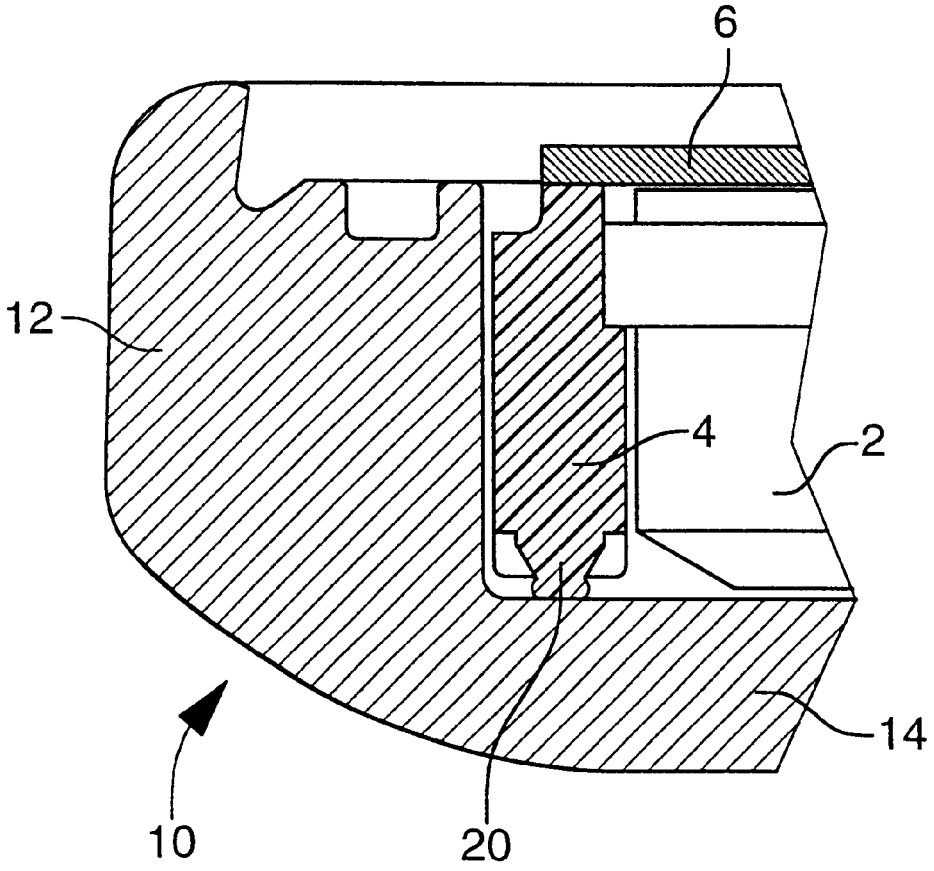
Fig. 2 PRIOR ART
Figure 3:
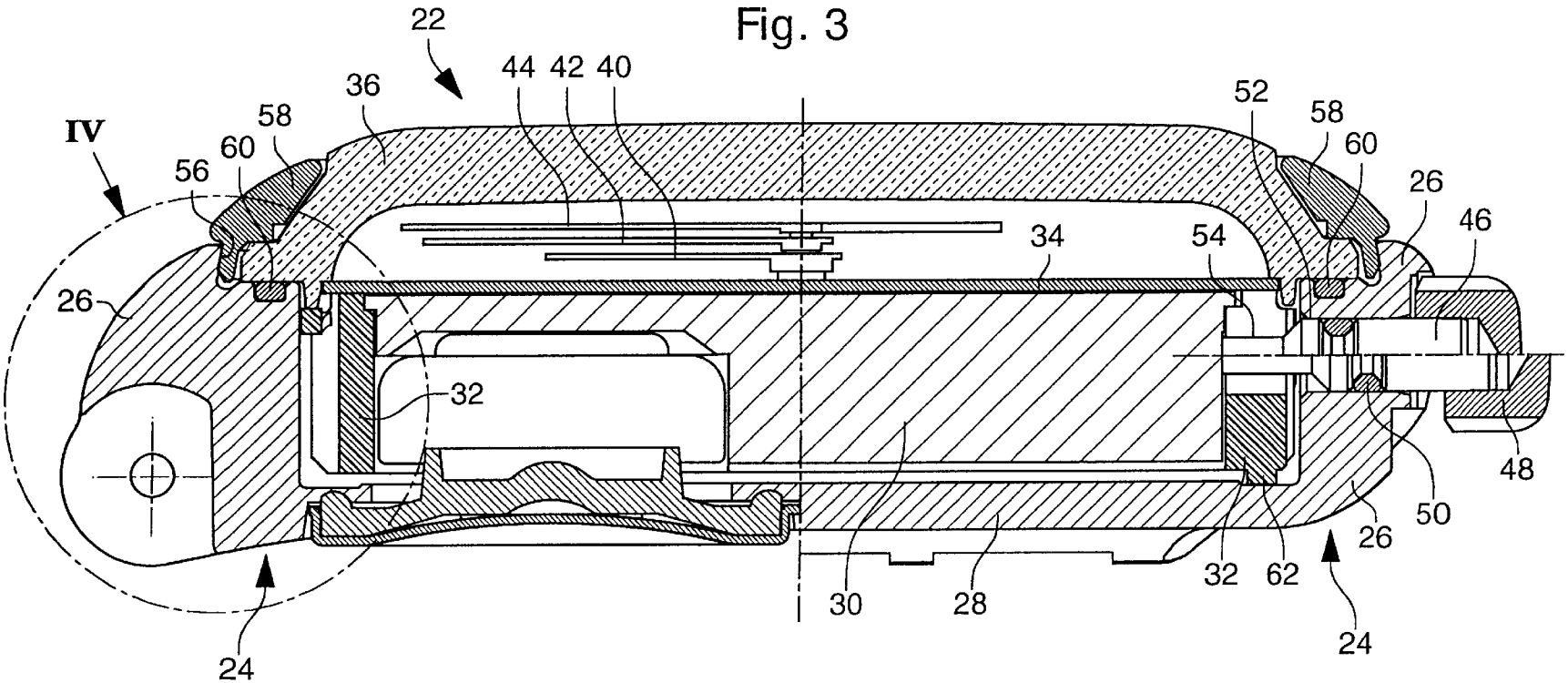
FIG. 3 is a general cross-section of a timepiece according to the invention.
Figure 4:
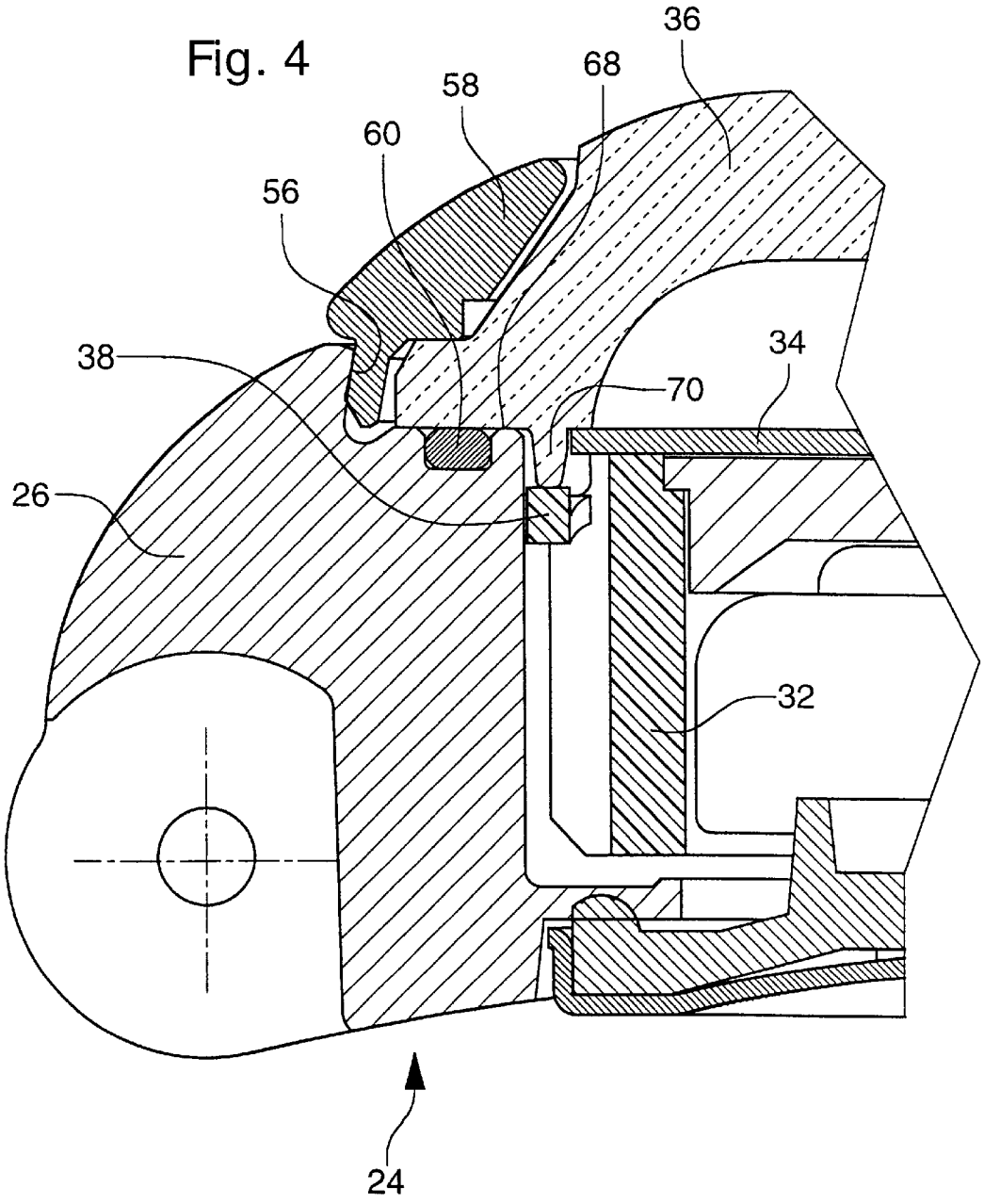
FIG. 4 is a larger scale view of the region surrounded by a circle in FIG. 3.

The timepiece according to the invention, designated as a whole by the general numerical reference 22, is shown in cross-section in FIG. 3. It includes a case 24 provided with a middle part 26 and a back cover 28 which, in the example shown, is made in a single piece with middle part 26. it goes without saying that the present invention applies in the same way to a case which is not in a single piece and which includes a back cover distinct from the middle part. Timepiece 22 also includes a movement 30 mounted in a casing ring 32, a dial 34 mounted above ring 32, and a crystal 36 mounted above dial 34. Crystal 36 rests on means 38 intended to eliminate the play due to dimensional tolerances of ring 32, dial 34 and back cover 28 of case 24, which will be described in detail hereinafter.

More particularly, movement 30 is provided with an hour hand 40, a minute hand 42, and a second hand 44 which rotate between dial 34 and crystal 36. Movement 30 also includes a time-setting stem 46 onto which a crown 48 is fitted. The sealing of stem 46 as regards case 24 is assured by an O-ring gasket 50. This time-setting stem 46 assures the angular orientation of ring 32 with respect to middle part 26 when watch 22 is assembled, in the event that middle part 26 and ring 32 are round. Indeed, holes 52 and 54, made respectively in middle part 26 and ring 32 must be able to be aligned properly in order to allow the time-setting stem to pass. Case 24 includes at its upper periphery a notch 56 in which is engaged a bezel 58 which secures crystal 36 onto case 24. Crystal 36 is sealed with respect to case 24 due to the use of a sealing gasket 60 wedged between the crystal and the case. Legs 62 are arranged under casing ring 32. These legs may, for example, by six in number, arranged at regular intervals from each other. These legs 62 cannot be deformed and are used solely to assure that ring 32 is properly held on back cover 28 of case 24.

Figure 5:
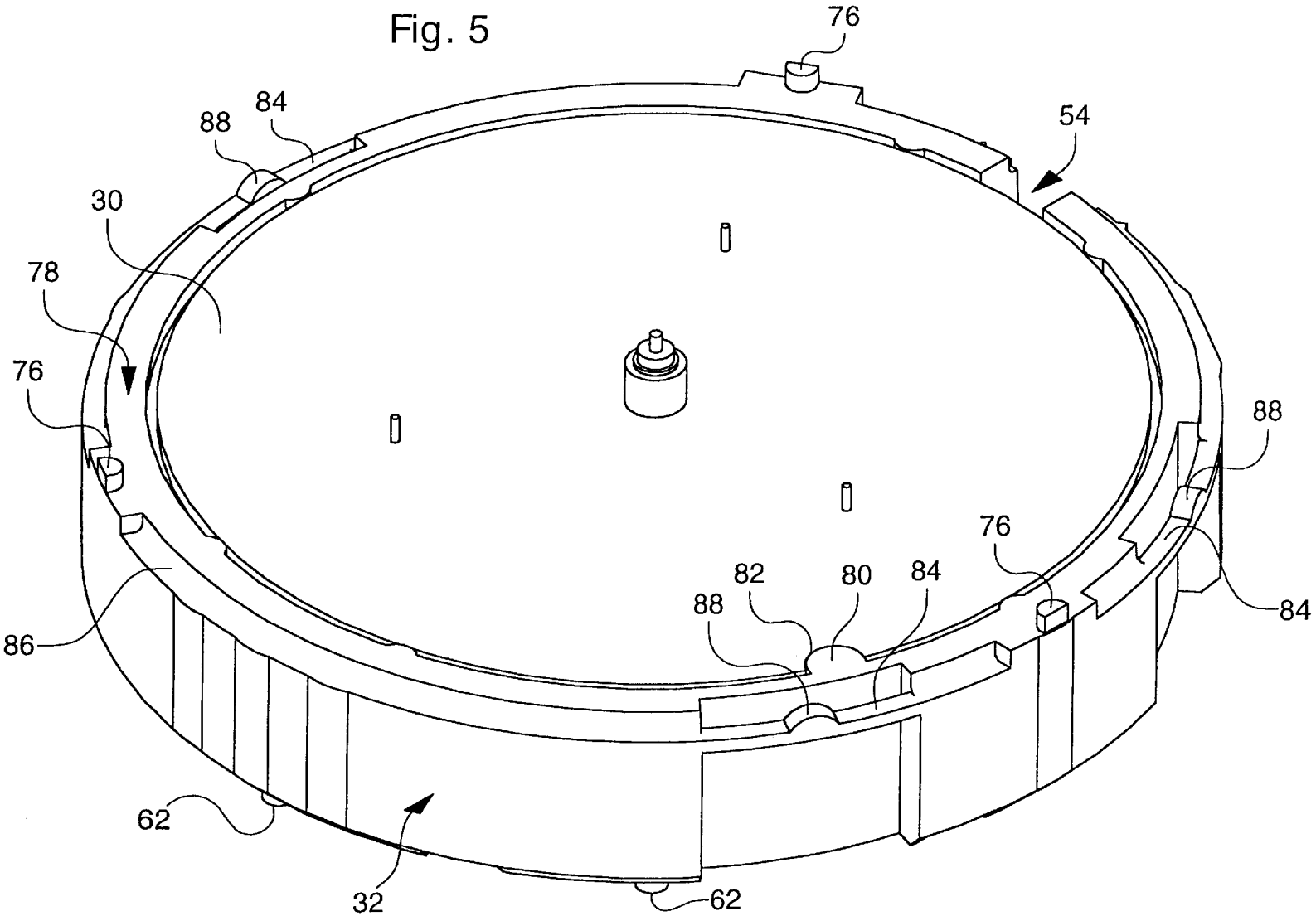
FIG. 5 is a general perspective view showing the casing ring in which a movement is housed.
Figure 6:
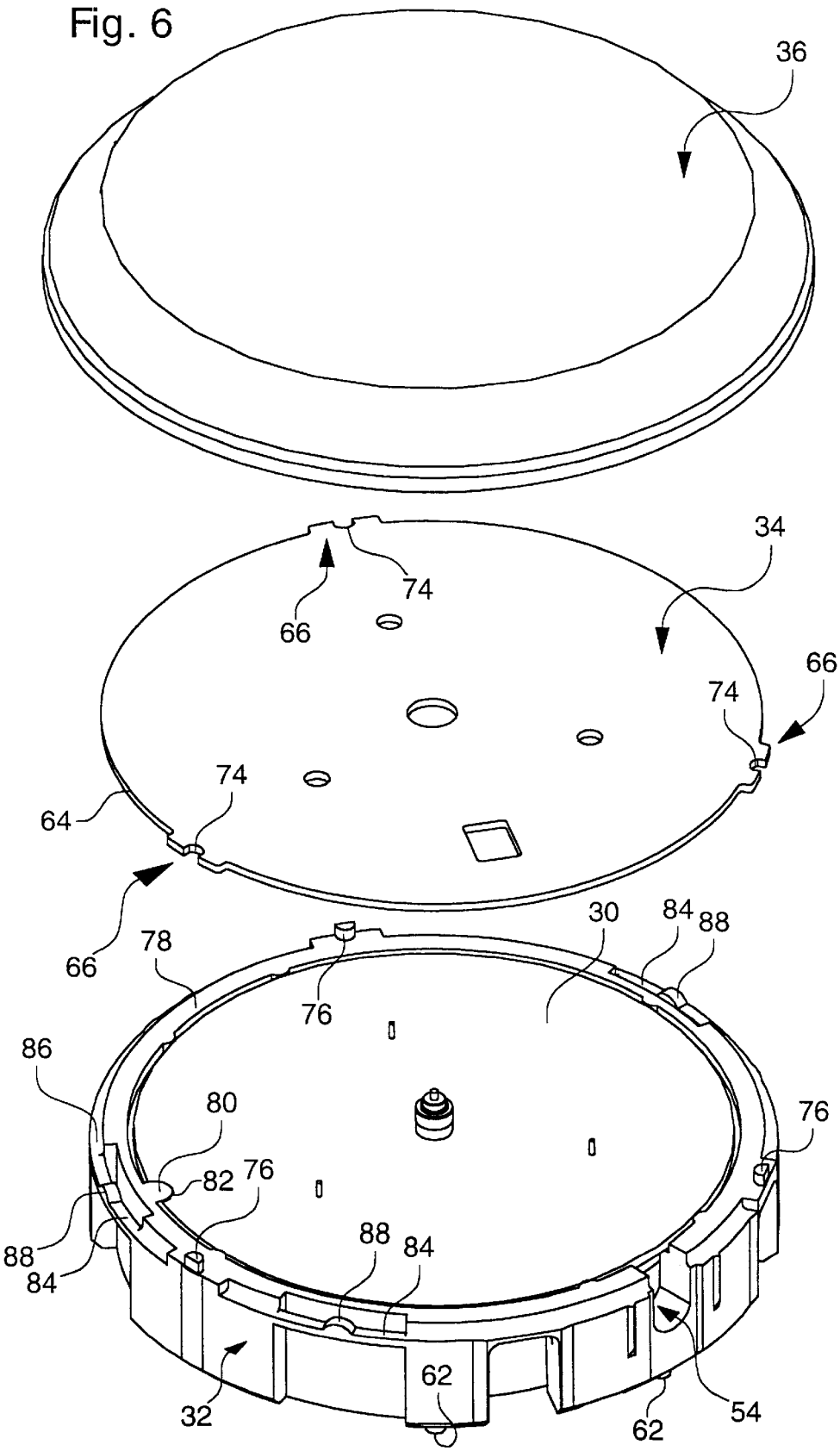
FIG. 6 is a blown up top perspective view of the assembly formed by the casing ring, the movement, the dial and the crystal.
Figure 7:
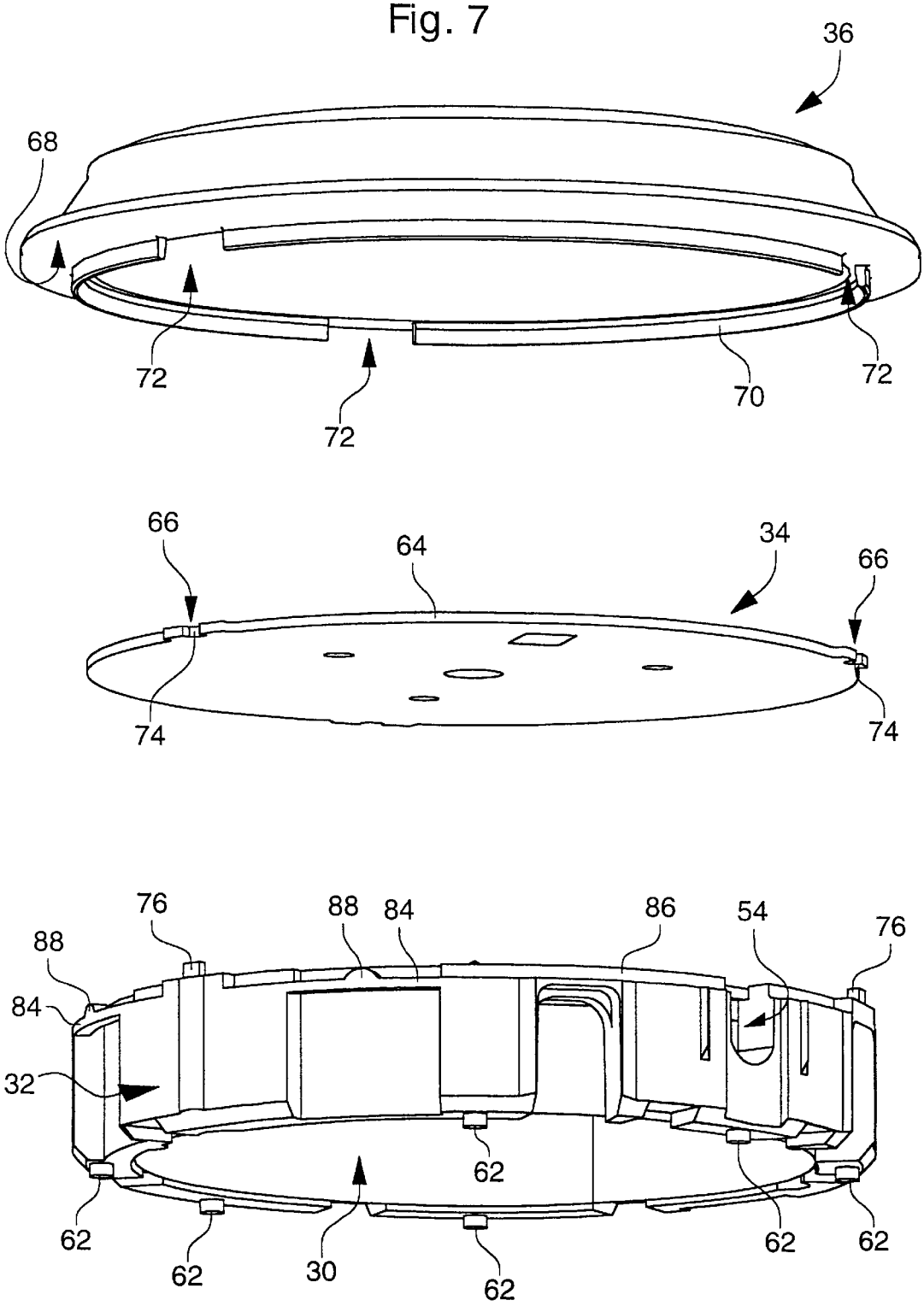
FIG. 7 is a blown up bottom perspective view of the same assembly as that shown in FIG. 6.
Figure 8:
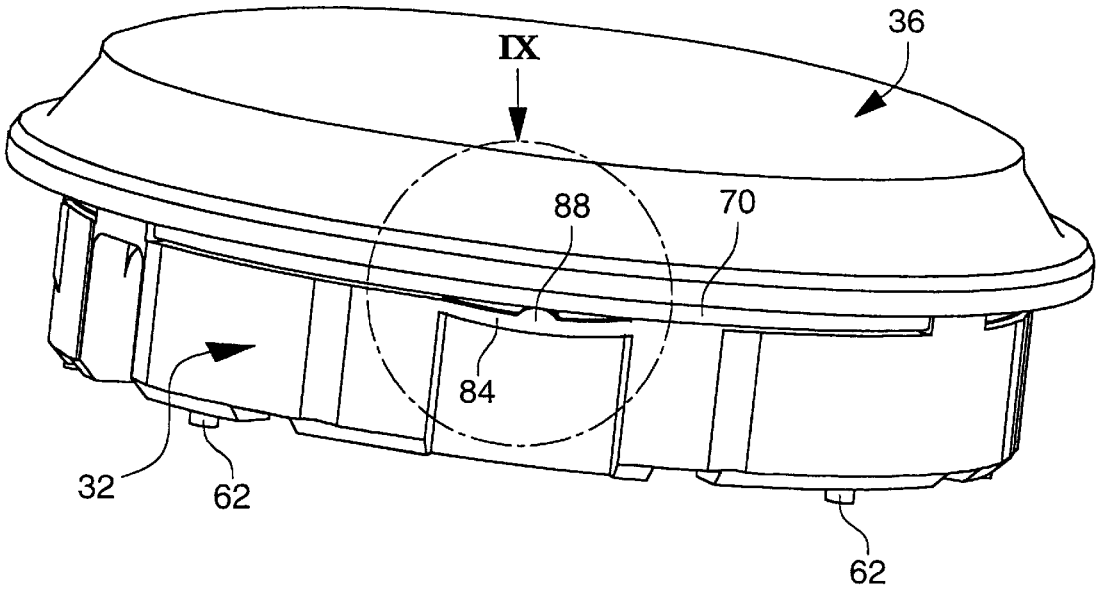
FIG. 8 is a perspective view showing the crystal placed on the casing ring and abutting via its collar on the flexible strips.

FIG. 5 is a general perspective view showing casing ring 32 in which movement 30 is housed. FIGS. 6 and 7 are respectively top and bottom views of ring 32, dial 34 and crystal 36 shown in blown up perspective.

It can be seen in the aforementioned Figures that dial 34 and crystal 36 are provided with means which fit together to angularly position and centre crystal 36 with respect to dial 34. The Figures show that dial 34 has a flank 64 from which three lugs 66 emerge, which overshoot the periphery of dial 34. As is apparent in FIGS. 6 and 7, crystal 36 is provided with an annular shoulder 68 which rests on dial 34 and a collar 70 which surrounds flank 64 of dial 34. This collar 70 is provided with three scallopings 72 arranged to cap lugs 66. The three lugs 66 and the three scallopings 72 which is imbricated on these three lugs 66 are distributed at equal distances from each other. It is thus possible to orient angularly and perfectly centre crystal 36 with respect to dial 34.

Lugs 66 are also used to secure and position angularly dial 34 with respect to casing ring 32. For this purpose, lugs 66 each have a notch 74. These notches 74 are arranged to each accommodate a corresponding stud 76 raised on top face 78 of casing ring 32. When dial 34 is pressed onto ring 32, studs 76 of ring 32 penetrate the respective notches 74 of lugs 66 of dial 34. In order to secure dial 34 definitively onto ring 32, studs 76 are thermally crushed. Finally, casing ring 32 has a raised portion 80 which penetrates a housing 82 of movement 30 in order to orient them with respect to each other when they have a round configuration.

FIGS. 5 to 9 clearly show that means 38 according to the invention intended to eliminate the play inherent in the dimensional tolerances of ring 32, dial 34 and back cover 28 of case 24 take the form of flexible strips 84 able to be elastically deformed. In the example shown in the Figures, these strips 84 are three in number, arranged respectively at 12 o'clock, five o'clock and seven o'clock. It goes without saying that the number and the arrangement of strips 84 can be modified as a function of requirements without departing from the scope of the present invention. Strips 84 are arranged at the top end of casing ring 32, along the outer circumference of the latter. Strips 84 each have a projecting portion via which collar 70 of crystal 36 rests on these strips 84. According to a preferred embodiment of the invention, the projecting portions of strips 84 are snugs 88. As a result of these strips 84, casing ring 32 and back cover 28 of case 24 can be machined with strict tolerances, typically of the order of several hundredths of a millimetre, so that passage holes 52 and 54 made respectively in middle part 26 and ring 32 to allow time-setting stem 46 to pass are still properly aligned, and that stem 46 therefore is not liable to become seized.

Figure 9:
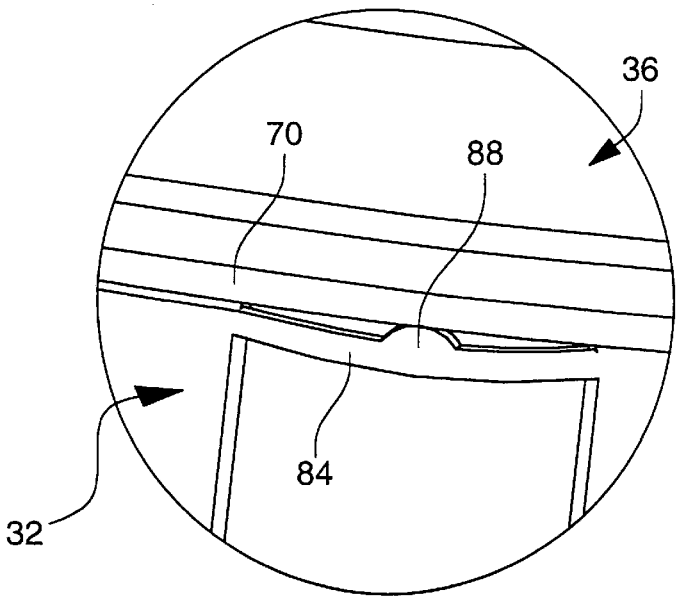
FIG. 9 is a larger scale view of the region surrounded by a circle in FIG. 8.

It is important to understand that the sum of the tolerances of the different constituent elements of timepiece 22 according to the invention is considerably less than the deformation amplitude of strips 84 which is of the order of several tenths of a millimetre. Thus, whether the play is positive or negative, it is eliminated, so that ring 32 and crystal 36 are still properly held against back cover 28 of case 24. Indeed, as FIG. 9 shows, crystal 36, pressed against ring 32 by bezel 58 which is driven into notch 56 of case 24, rests on strips 84 via its collar 70, which has the effect of elastically deforming these strips 84 downwards, thus creating a pressure force which applies ring 32 against back cover 28 of case 24. The resting of collar 70 of crystal 36 on flexible strips 84 is still achieved insofar as, when crystal 36 is mounted in case 24, collar 70 descends to a slightly lower level than the level at which the top of snugs, which are raised on strips 84 when they are at rest, 88 is located.

It goes without saying that various simple modifications and variants fall within the scope of the present invention.

What is claimed is:

1. A timepiece including a case provided with a back cover and a middle part, a movement mounted in the casing ring, a dial mounted above the ring and a crystal mounted above the dial, said crystal being provided with an annular collar surrounding the flank of the dial, wherein the casing ring includes means arranged to remove all the play inherent in the dimensional tolerances of the dial, the ring and the back cover of the case, said means supporting the collar of the crystal and being arranged at the upper end of the ring, along the outer circumference thereof.

2. A timepiece according to claim 1, wherein the means for removing the play inherent in the dimensional tolerances of the dial, the ring and the back cover of the case are flexible strips able to be elastically deformed.

3. A timepiece according to claim 2, wherein there is a projecting portion mounted above the strips via which the collar of the crystal rests on said strips.

4. A timepiece according to claim 3, wherein, when the crystal is mounted in the case, its collar descends to a slightly lower level than the level at which the projecting portions which are raised on the flexible strips are located when the latter are at rest.

5. A timepiece according to claim 3, wherein the projecting portions are snugs.

6. A timepiece according to claim 2, wherein the strips are three in number, arranged respectively at 12 o'clock, five o'clock and at seven o'clock to assure that the crystal is properly held.

* * * * *